United States Patent [19]

Barhydt, Sr. et al.

[11] Patent Number: 4,967,784

[45] Date of Patent: Nov. 6, 1990

[54] AIR BREAK STRUCTURE ADAPTED FOR USE IN THE BASE OF AN ACCESSORY FAUCET

[75] Inventors: Dirck Barhydt, Sr., Middlebury; Frank J. Agresta, Wallingford, both of Conn.

[73] Assignee: WPM, Inc., Waterbury, Conn.

[21] Appl. No.: 448,526

[22] Filed: Dec. 11, 1989

[51] Int. Cl.[5] ..... F16K 24/00

[52] U.S. Cl. ..... 137/216; 137/801

[58] Field of Search ..... 137/216, 801

[56] References Cited

U.S. PATENT DOCUMENTS

| | | | |
|---|---|---|---|
| 3,183,923 | 5/1965 | Hendrikson | 137/216 |
| 3,578,016 | 5/1971 | Kushner | 137/216 |
| 4,635,673 | 1/1987 | Gerdes | 137/216 |
| 4,771,485 | 9/1988 | Traylor | 137/216 X |

*Primary Examiner*—Gerald A. Michalsky

*Attorney, Agent, or Firm*—Dallett Hoopes

[57] ABSTRACT

This faucet has a base assembly with an air break module for the brine waste from a reverse-osmosis filter. The break outlet at the bottom of the break pocket has an angled fitting which aims the downstream waste up out of the base assembly in event of a backup. The faucet includes a unitary valve stem, the lower end of which is tapered and sits in a cup-shaped valve element for low-friction connection and easy swiveling adjustment of faucet outlet. Finally, the faucet is installed with the use of a pair of interfitting plates, one, the base plate, secured to the bottom of the faucet base, the other, the attachment plate, secured to the sink around the access hole in the sink. The attachment plate has upstanding outward ears which fit into tapered openings in the base plate. When the base is turned, for 20° or so, the ears wedge against the sides of the openings respectively to give a tight fit, securing the faucet in the sink.

12 Claims, 5 Drawing Sheets

AIR BREAK STRUCTURE ADAPTED FOR USE IN THE BASE OF AN ACCESSORY FAUCET

BACKGROUND OF THE INVENTION

This invention relates to accessory faucets, or so-called "third faucets", which are usually installed on the sink top to the side of the traditional hot and cold water faucets. The accessory faucet is connected to a source of filtered water usually in the form of the outlet of a reverse osmosis filter.

In such a reverse osmosis filter there is a brine line which is to be connected to waste. Regulations require that there be an air break in the brine waste line. Such an air break, in order not to leak waste onto the kitchen floor in normal operation, is disposed above the sink level. Conveniently it is incorporated in a module in the base of the accessory faucet. This arrangement is disclosed in U.S. Pat. No. 4,635,673 which issued Jan. 13, 1987 to Gerald E. Gerdes, and assigned to our assignee.

The air break module of Gerdes and other air breaks in the art will suitably prevent, on the occasion of a severe drop in building water supply pressure, the siphoning back of material from waste back into the filter chamber through the brine line and thence into the cold water supply system of the building.

However, it does not take care of another recognized serious incident: the occasion of build-up of back pressure created by a blocked-up downstream sewer line. In such an instance a pressure head can be built up in the waste line of the building so that a very positive pressure appears in the brine line outlet, to reverse the flow of liquid in the brine line. In extreme cases this can produce a jet of waste in the module aimed up through the break up into the brine line inlet and thereby cause entry of waste into the upstream side of the filter and again into the cold water system of the building.

In summary, the air break modules in reverse-osmosis filters of the prior art successfully prevented the introduction of waste into the building water supply from upstream siphonage. They have ignored, however, an equally substantive source of contamination: back pressure from downstream blockage.

The invention also involves an improvement in the valve. In the Gerdes patent the in-line valve includes a stem which is two pieces threaded together. In the past, the holding of the lower end of the stem by the frictional engagement of the valve gasket against its seat has occasionally caused an unscrewing of the two parts of the stem as the spout outlet is swiveled in use. This, of course, is undesirable. At the same time, even if the stem has maintained its unity without unscrewing, the frictional drag of the gasket against the seat has made less easy the swiveling adjustment of the faucet outlet.

Finally, the invention includes an improvement in installation. In the Gerdes patent the installation of the valve/module is accomplished by sticking the threaded inlet pipe down through an opening made in the sink top and laboriously from underneath the sink threading upward a nut wide enough to clamp against the underside of the sink about the hole. This has not only been awkward but has been time-consuming.

Identification of Related Art under §§1.97 and 1.99

Aside from the above mentioned Gerdes patent, there are a number of patents pertinent to the idea of air breaks. Examples are shown in the following U.S. Pat. Nos.: 3,023,767; 3,158,169; 3,183,923; 3,411,524; 3,512,545, 3,578,016; German published application No. 29 08 824.

In addition, there are further showings of such air breaks combined with faucets. Examples are: U.S. Pat. Nos. 3,620,241; 3,967,638; 4,134,419; 4,210,533; 4,454,891.

Aside from the above-mentioned Gerdes patent, there are a number of showings of in-line valves. As examples are: U.S. Pat. Nos. 218,135; 2,621,746; 4,260,130; also French Pat. Nos. 734,644 and 976,597.

The prior art also suggests means for attaching such accessory faucets and air break modules to the top of a sink. An example, of course, is the Gerdes patent mentioned above.

SUMMARY OF THE INVENTION

While the arrangement shown in the Gerdes patent is meritorious in every respect, the present invention relates to improvements on the structure disclosed in Gerdes.

The present invention is a faucet which includes in its base an air break module. The module has a break pocket extending in from one side and having an upward lower lip. The brine inlet orifice is aimed down vertically as is conventional from an orifice at the top of the pocket. The brine outlet is disposed at the bottom of the pocket at the bottom of the lip. It includes, however, a nozzle-like outlet fitting which, rather than being aimed directly up at the brine inlet orifice, is aimed outward of the pocket so that should there be developed a back pressure as discussed above, waste will wind up innocuously outside of the module. There is thus eliminated any danger of forceful contamination upstream in the building supply line.

In a preferred form of the invention an eduction cove is created in the pocket adjacent the inlet orifice so that in the event of downstream back pressure, the fast-moved stream of backed-up waste will create a negative pressure in the cove adjacent the orifice to suck incoming brine waste out the pocket opening with the backed-up waste.

The invention also involves an improved form of in-line valve wherein vertically disposed valve stem is one piece and the valve element which sits on the valve seat is cup-shaped and receives the bottom of the stem in its opening. The bottom of the stem may be tapered to reduce friction between the stem and the element so that the faucet outlet may be readily swiveled.

The invention may also be described as a quick-attaching means for installing the accessory faucet with or without an air break module on the sink top. It comprises a pair of plates, one, the base plate, secured to the bottom of the faucet base; the other, the attachment plate, secured to the sink around the access hole. The attachment plate has upstanding outward ears which fit into tapered openings in the base plate.

The threaded pipe and other connections including the brine tubes and electric leads to an indicator on the base assembly housing pass through the openings in the base and attachment plates. The faucet base assembly housing is turned a fraction of a turn to tighten it. This eliminates under-the-counter work and a lot of manipulating and rotating of the usual attachment nut by the plumber in the installation of the faucet.

BRIEF DESCRIPTION OF DRAWINGS

Other objects and features of the invention will be understood by those skilled in the art from a study of the following specification and drawings, all of which show nonlimiting embodiments of the invention. In the drawings.

DESCRIPTION OF THE PREFERRED EMBODIMENT

Figure 1:
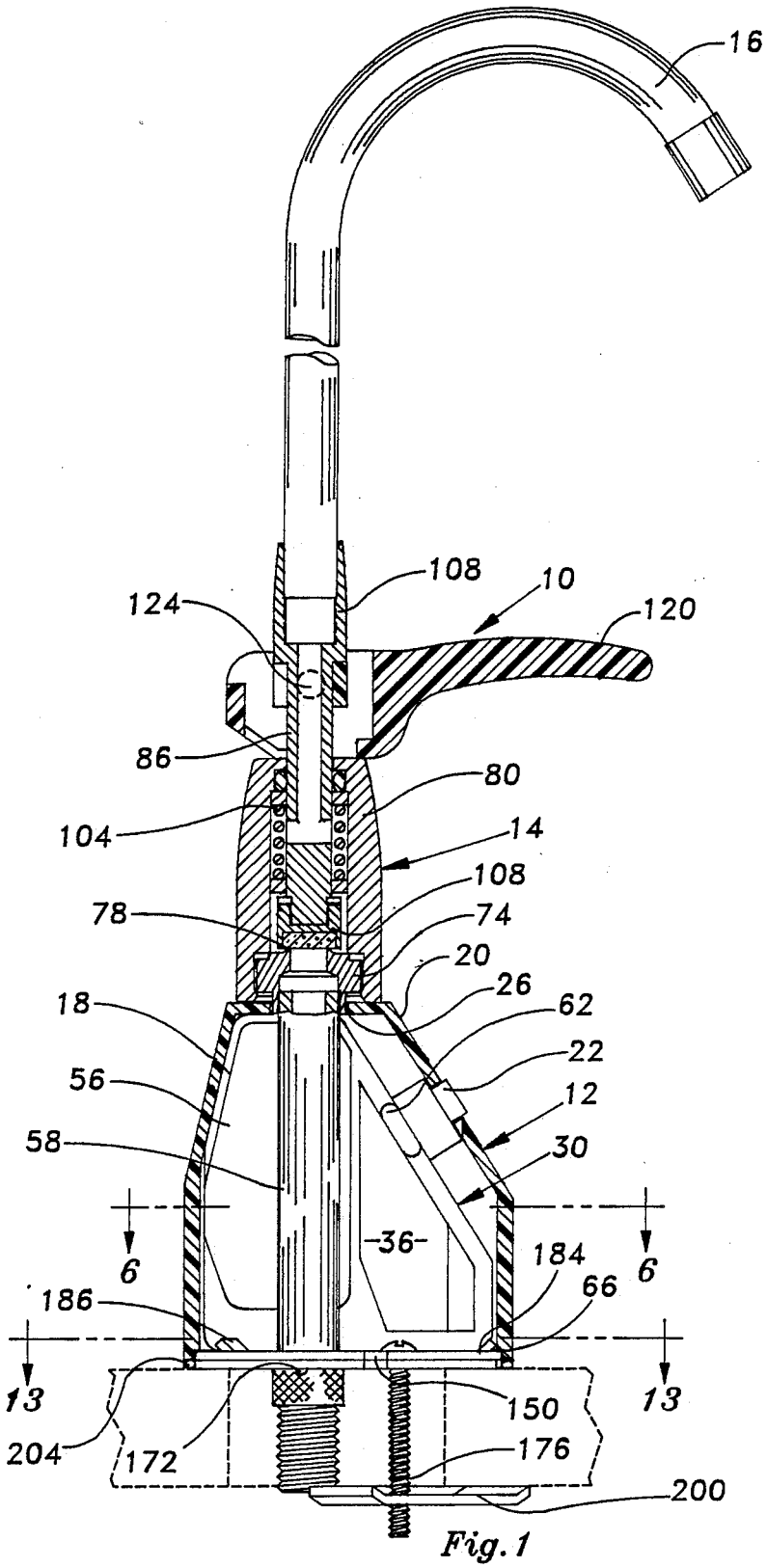
FIG. 1 is a vertical centerline sectional view of an embodiment of the invention having the module partly broken away to show one of the ears. The sink is shown in phantom.

An accessory faucet embodying the invention is shown in FIG. 1 and generally designated 10. It comprises a base assembly 12 containing an air break and an in-line valve assembly 14 mounted thereabove. A swivel spout 16 extends upward from the valve assembly as shown.

Figure 2:
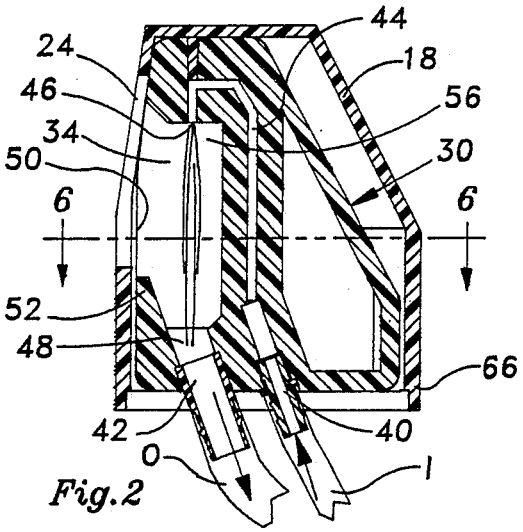
FIG. 2 is a sectional view showing the air break module in normal operation.

Base assembly 12 comprises an inverted cup-shaped housing 18. The housing 18 may present an inclined front panel 20 apertured to present a display 22 having a suitable LCD element for indicating the condition of the filter. The housing 18 is formed with a rear window 24 (FIG. 2). The top wall of the housing is apertured at 26.

Inside the base assembly 12 is an air break module 30. The module 30 comprises a molded body 32 (FIGS. 6, 8) having a break recess 34 and a lightening recess 36 spaced therefrom by a central web 38. Pressed into the lower portion of the module are a brine inlet fitting 40 and a brine outlet fitting 42. The fittings are provided on their outer ends with hose-engaging barbs as shown.

Molded into the central web 38 is a channel 44 which extends from the inside end of the fitting 40 along the web and up adjacent the top of the body and then turning down, as shown, to terminate in a downward inlet orifice 46 into the break recess 34.

From the upper end of the outlet fitting 42 a passage extends upward to terminate in an orifice 48 into the break recess 34. Opening 48 is directly underneath the inlet orifice 46 so that as shown in FIG. 2 incoming brine passes from the orifice 46 down to be received into opening 48 to drain to waste.

From the break recess 34 in the module an access 50 extends laterally to the outside of the body 32. The access is shaped to leave a lip 52 so that the access 50 is spaced above the opening 48 of the brine outlet.

Figure 8:
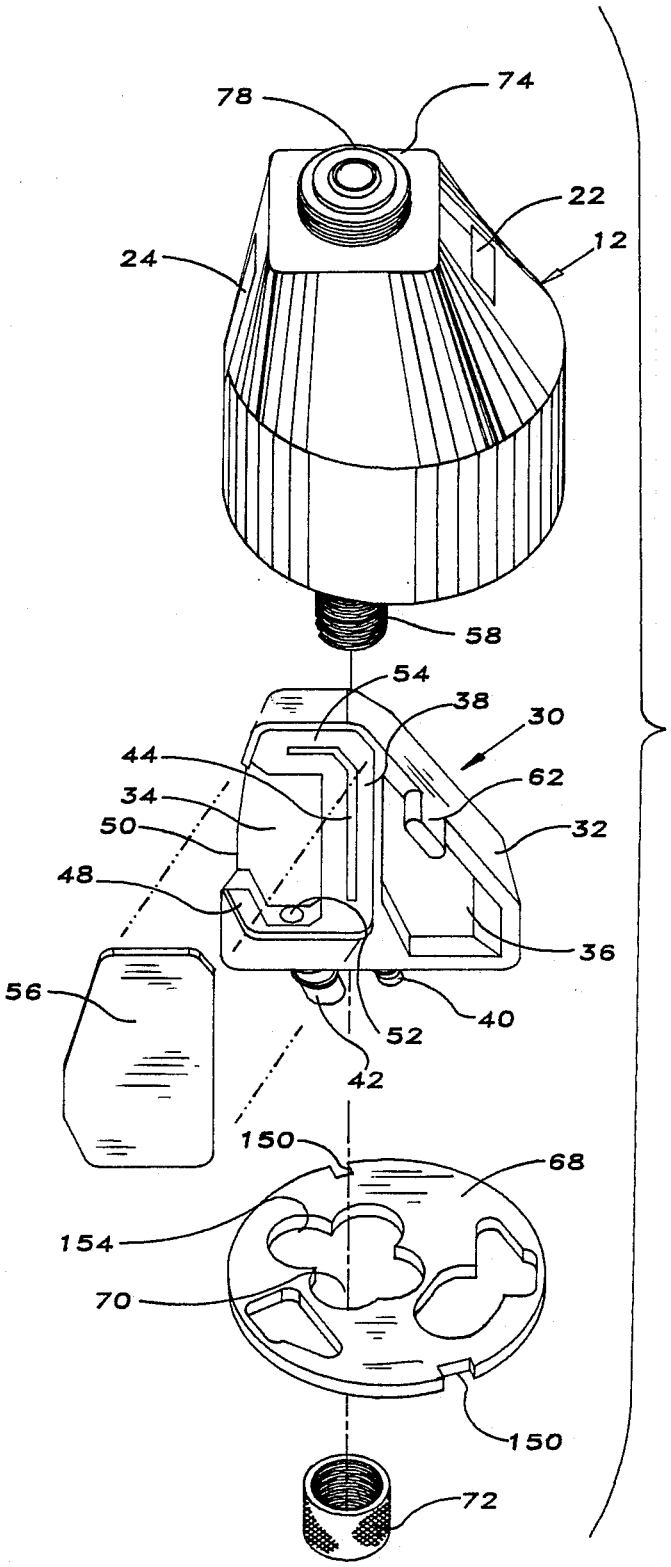
FIG. 8 is a perspective exploded view of base assembly embodying the invention.

As shown best in FIG. 8 the break recess is surrounded by a shallow ledge 54 except in the area of the lateral access 50. Completing the module 30 is a closing plate 56, which may also be of plastic and which conforms to the shape of the boundaries of the ledge 54.

In assembly of the module the plate 56 is ultrasonically welded or otherwise secured into the space defined by the boundaries of the ledge 54 and has the effect of closing off the channel 44 and the break recess 34 so that the channel becomes an inlet passage (also designated 44 for convenience) and the recess 34 becomes a break pocket (also designated 34 for convenience). The plate 56 also makes the lateral access 50 a vertically elongate port (also designated 50 for convenience). Port 50 is aligned in the base assembly with rear window 24 (FIG. 8) in the housing.

An essential feature of the module under the invention is that the opening 48 leading from the outlet fitting 42 and the fitting 42 itself is angled from the vertical so that should there be a backup in the downstream waste line, any liquid flowback will be directed (FIG. 3) out the port 50 and window 24 so that there will be no chance of contamination of the inlet line 44, 40, I with the downstream waste. As an example, the angle from the vertical at which the outlet opening 48 is canted is 20°.

As an added feature the shape of the pocket 34 will preferably include an upward eduction cove 56 in the area of the brine inlet orifice 46 for reasons which will appear.

Figure 5:
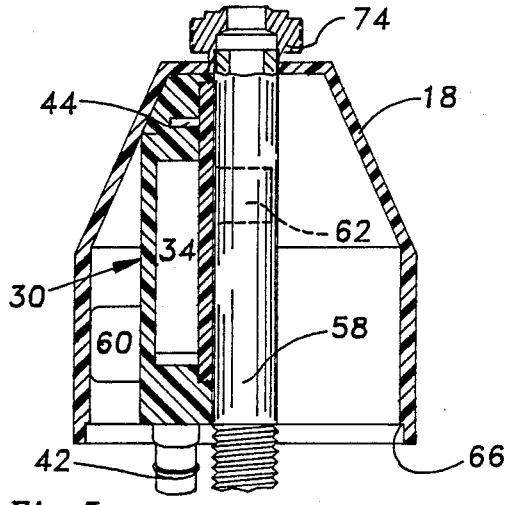
FIG. 5 is a sectional view taken on the line 5—5 of FIG. 4.
Figure 6:
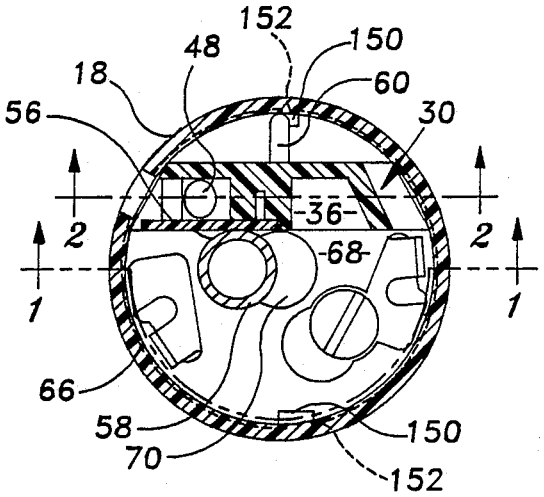
FIG. 6 is a slightly enlarged sectional view taken on the line 6—6 of FIG. 2.
Figure 7:
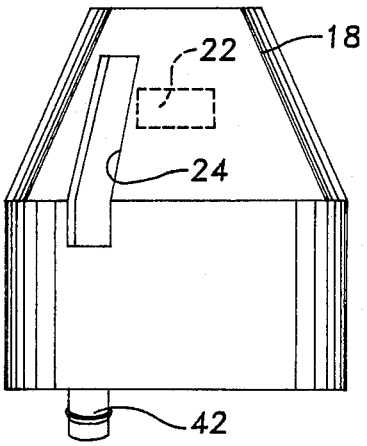
FIG. 7 is a rear view of the module base.

As shown best in FIGS. 5 and 6 the wall of the module 30 toward the inside of the base rests against the central supply pipe 52 for the faucet. From the far side of the module 30 extends outward an integral fin 60, the end of which engages the inside of the housing 18 to immobilize the module and hold it in proper position against pipe 58. Further, the sides of the module body may be angled to confirm to the adjacent surfaces of the inside of the housing 18 (FIG. 6).

Extending laterally out from the front of the module toward the center of the housing 18 is the indicator support tab 62 which is adapted to support the LCD display 22 in its opening in the front of the housing 18.

The normal operation of the break module 30 within the base assembly 12 (FIG. 2) is that the waste line I from the reverse osmosis filter unit is connected to the inlet fitting 40 and travels up the passage 44 which turns downwardly to connect with orifice 48. The brine waste is thus directed downwardly and accumulates to a small degree in the bottom of the pocket below the lip 52. From there it drains outwardly through the outlet opening 48 and fitting 42 and through line 0 to downstream waste. This is the normal operation for air breaks and to this extent the present device does not function differently from the air break modules in the past.

Figure 3:
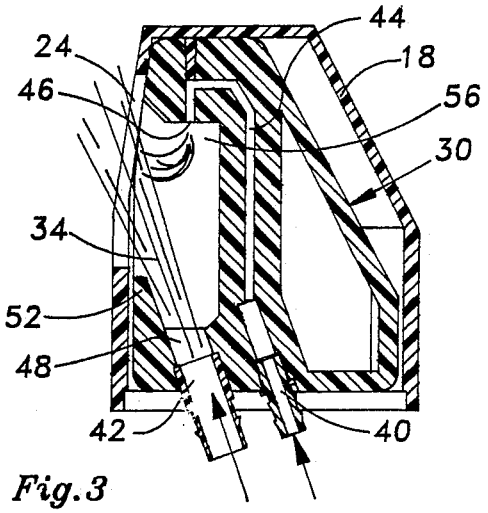
FIG. 3 is a sectional view showing the air break operating with back pressure on the outlet.

However, on the occasion of the development of back pressure in the downstream waste line 0 due to a downstream blockage, downstream waste liquid may reverse flow up the waste outlet line 0 and forcefully through the fitting 42. The fitting 42 and opening 48 direct the waste out the port 50, as shown in FIG. 3. Because of the inclination of the opening 48 and fitting 42, the flow is not aimed at the orifice 46 which might otherwise result in the contamination of the liquid upstream. It is instead (FIG. 3) directed out the top of port 50 and the window 24 in the housing.

In most cases the flow through the brine inlet 40 and passsage 44 and through the orifice 46 will continue despite the back pressure build-up in the situation described above. In the eduction cove 56 to the side of the downstream jet a negative pressure is created as waste back-up speeds by as shown in FIG. 3. This negative pressure causes the filter waste from orifice 46 to be drawn into the outward and upward stream, whereby the inflowing filter brine waste, as well as the backed-up downstream waste, is ejected to the outside of the base assembly 12.

Figure 4:
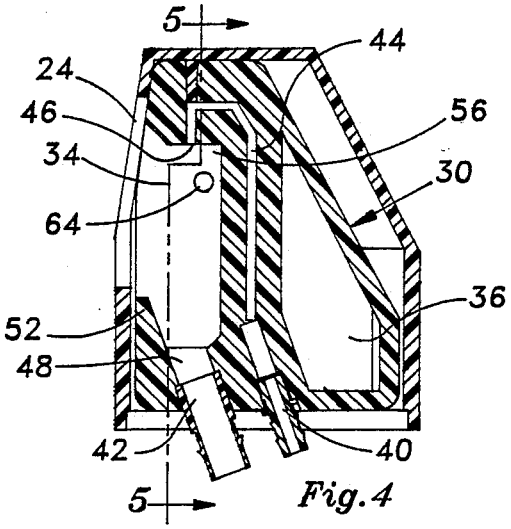
FIG. 4 is a sectional view similar to FIG. 1 of the module showing the modifing form of module.

Because the negative pressure in the eduction cove may at some time have a destructive effect of the flow path of the outwardly projected back-up waste, the FIG. 4 version provides a vacuum relief opening 64 in the side wall of the pocket 34. The relief opening 64 permits inward flow of air to relieve this.

In the event that there should be a rearward siphonage of the filter waste due to a pressure drop upstream in the waste line, the air break operates in the same manner as air breaks of the past devices including that disclosed in the Gerdes patent mentioned above.

In the unusual event of the simultaneous upstream siphonage and downstream back pressure, there will be the upward and outward shooting of the downstream waste as shown in FIG. 3 and the inward sucking of air through the orifice 46. It is in this combination of circumstances in which the negative pressure relief opening 64 is especially desirable. Such relief accommodates the inward siphonage of gas through the orifice 48 as well as the negative pressure created by the rapid flow of downstream waste upward through the fitting 42.

The lower end of the housing 18 is circular and is undercut to provide a downward annular shoulder 66 up against which a circular base plate 68 is secured. The plate 68 is apertured at 70, to be explained more fully later. Aperture 70 permits passage of the threaded faucet supply pipe 58 and a threaded nut 72 is screwed onto the pipe and snugged up against the plate 68 pressing it against shoulder 66 to close the assembly.

DESCRIPTION OF THE VALVE IMPROVEMENT

The threaded pipe 58 which extends upward through the base assembly 12 (FIG. 9) threadily engages at its upper end a valve base 74. The base 74 is exteriorly threaded and has a central valve opening 76 with an upward annular seat 78 thereabout. A hollow plastic housing 80 is formed with a central bore 82 which is enlarged and threaded at 84 at its lower end. In assembly this threaded enlargement threadedly engages the valve base 74 (FIG. 1) to secure the housing in place above the base assembly so that its lower end forcefully abuts the top wall of the base assembly 12.

A one-piece stem 86 is centrally located within the housing 80 and has an upward enlargement 88. A bore 90 extends downward from the upper end of the stem 86 and is reduced to a passage 92 which extends downward through a reduced exterior of the stem to terminate in radial outlet ports 94.

Spaced slightly up from the lower end the stem is formed with an annular groove 96 which receives a snap ring 98. The lower end of the stem is tapered as at 100. The central bore 82 of the housing (FIG. 9) is reduced adjacent its upper end to form a shoulder 96, and a washer 102 encircles the stem 86 and bears upward against the shoulder 96. Beneath the washer the stem is encircled by a spring 104 and a second washer 106 rests against the snap ring 98, the spring 104 being in compression to urge the stem 86 down into seating position.

Figure 9:
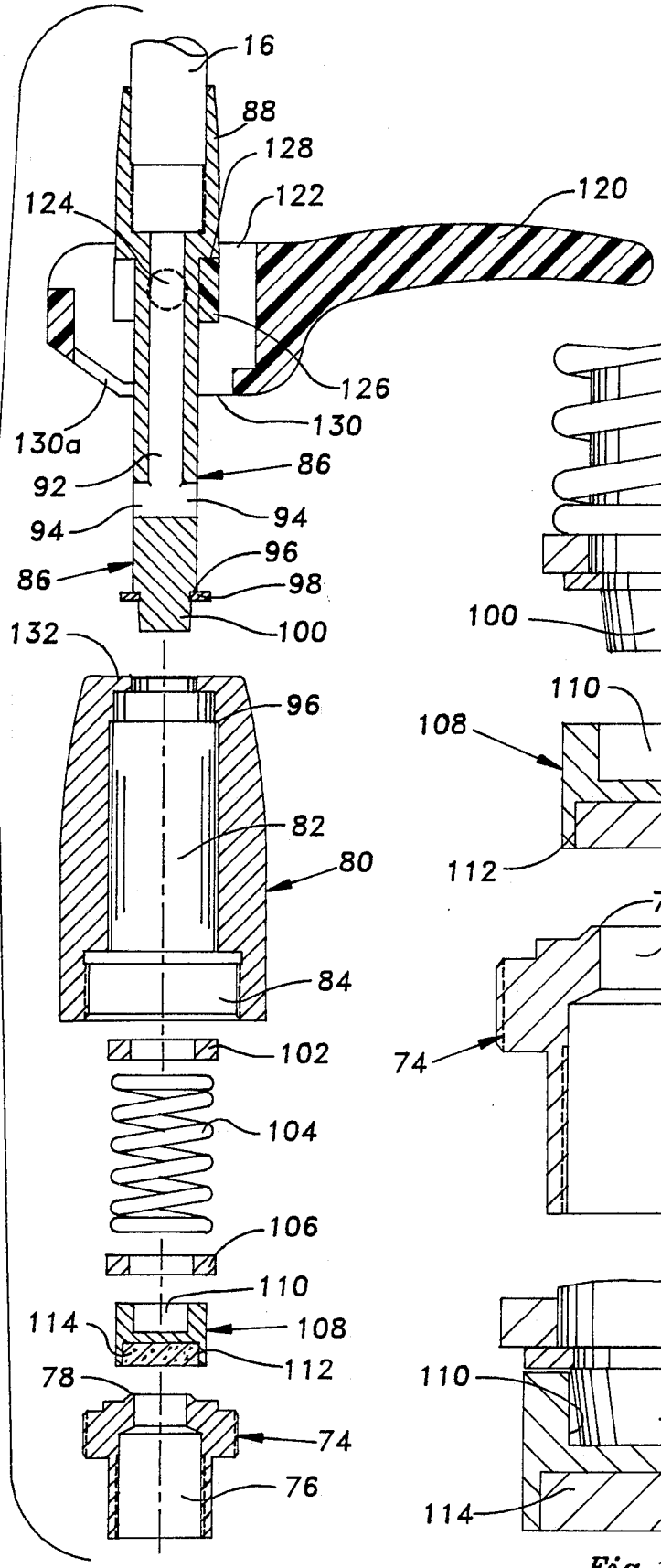
FIG. 9 is an enlarged exploded view of an in-line valve embodying the invention.
Figure 10:
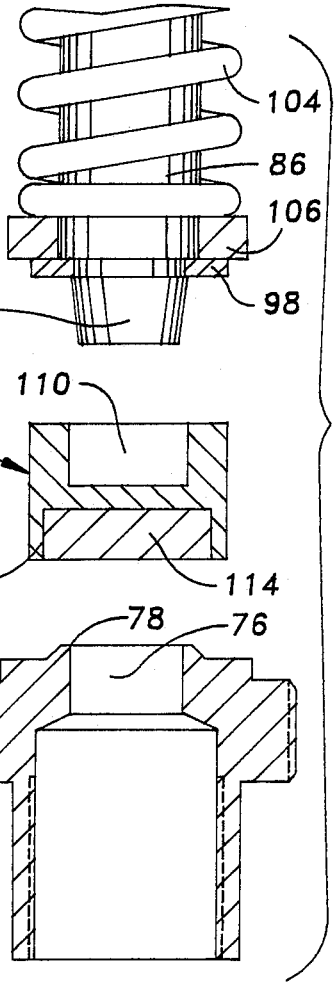
FIG. 10 is a greatly enlarged exploded view of the valve components.
Figure 11:
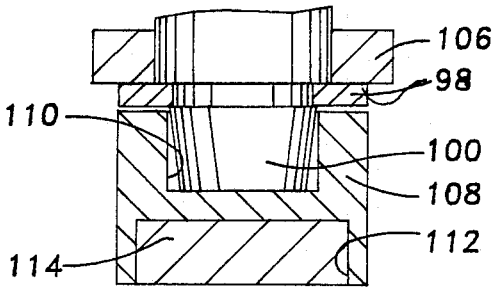
FIG. 11 is an assembled view showing the assembled relationship between the stem and valve element.

The lower tapered end 100 of the stem is received into a cup-shaped element 108 having an upward opening 110 (FIG. 9). The lower end of the cup-shaped element 108 is formed with a circular recess 112 which receives a disc-shaped gasket 114 adapted, when the valve is closed, to sealingly engage against the seat 78.

As customary, a perpendicular handle 120 has an attached ring 122 which loosely encircles the stem and which has inward trunions 124 which engage in suitable upward notches in a boss 126. The boss snugly encircles the stem 86 and bears upward against a shoulder 128 at the lower end of the enlargement 88.

The ring 122 has a lower surface 130 (FIG. 9) which bears against the upper end 132 of the housing 80 so that when the handle 120 is lifted by its outward arm, the stem 86 is drawn upward by the trunions 124 as they raise. The raising of stem end 100 will permit the valve element 108 to raise from its seat 78. With the handle raised sufficiently, the flat surface 130*a* (FIG. 9) of ring 122 will come to rest on the surface 132 holding the stem 86 upward in stability against the force of spring 104.

It should be clear that there is clearance between the sides of the lower end 100 of the stem 86 and the side walls of the cup-shaped element 108 so that only the bottom surface of the lower end of the stem 86 touches the bottom of the opening 110 in the cup-shaped valve element 108. Because of this limited contact between the two parts, the spout 16 firmly secured in the opening 90, may be readily manually swiveled as the two parts turn relatively. It will be noted that the valve element 108 is not secured to the stem 86: The valve element is raised by water pressure.

DESCRIPTION OF THE MOUNTING MEANS

Figure 12:
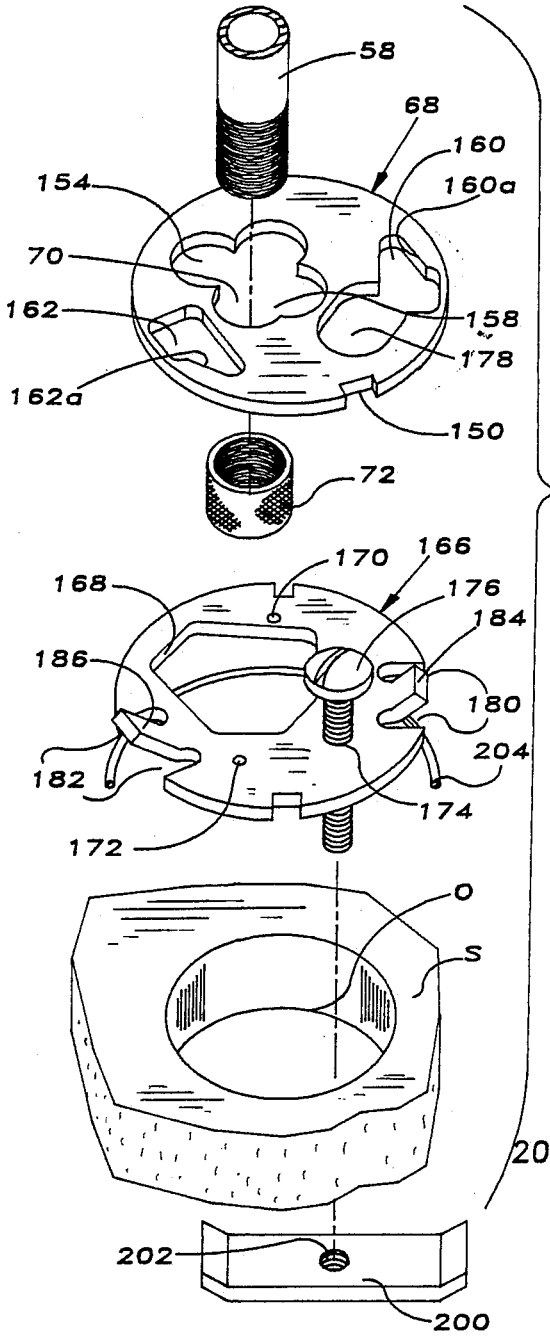
FIG. 12 is an exploded view showing the components relating to the installation of the faucet.

As already described and as shown in FIG. 12, the base plate 68 which closes the housing 18 is formed with a supply-pipe-receiving aperture 70.

As shown, the base plate 68 is circular and is formed with keyways 150 in its periphery. In assembly the keyways 150 receive short longitudinal ribs 152 (FIG. 6) to keep the base plate 68 keyed to the rotation of the housing 18 as the unit is installed. Adjoining opening 70 plate 68 is also formed with enlarged aperture 154 (FIG. 12) which receives the brine outlet hose O and fitting 42 and brine inlet hose I and fitting 40 as well as the wire from the reverse osmosis filter. That wire goes up to the LCD display 22 in the front of the unit.

For installations in which no base assembly 12 is desired or necessary, opening 158 part of enlarged aperture 154 and which is central in the plate 68, may be used to pass the threaded supply pipe 58 directly to the knurled nut 72. In such instances a cosmetic face plate may surround the pipe 58 intermediate base plate 68 and the bottom of the valve housing 80.

Base plate 68 is also provided with shoe-shaped openings 160 and 162 which to assure proper orientation of the base assembly 12 in installation are not diametrically opposite each other. The shoe-shaped openings 160 and 162 are formed with their inclined surfaces 160*a* and 162*a* inclined away from the periphery of the plate 68 as the "point" of the "shoe" is approached. The "shoes" of the apertures 160 and 162 both point in the same rotary direction.

In installation the threaded pipe 58, which is to the side of the center line of the circular base of the housing 18, fits through the opening 70 which is equally offset from the center of plate 68. The threaded lower end of supply pipe 58 extends below the plate 68 and the fittings 40 and 42 as well as the LCD wire extend through the openings as indicated. The plate 68 is raised to fit snugly against the shoulder 66 at the bottom of the housing, the keys 152 disposed in the keyways 150 of plate 68. The knurled nut 72 is then screwed into supply pipe 58 against the bottom of the plate 68 firmly to attach together the valve 14 with its spout 16 and the base assembly 12.

A circular installation plate 166 of the same diameter as plate 68, is also provided (FIG. 12) As shown, the plate 166 is formed with a large single access opening 168 generously formed and generally in line with the composite opening 70, 154, and 158 of the base plate 68. On either side of the access hole 168 are downstruck dimples 170, 172 which result in downward nibs (not shown) on the underside of plate 186, and a hole 174 receives a headed fastener, preferably a bolt 176.

As shown best in FIG. 12 the periphery of the installation plate 166 is formed with pairs of parallel inward notches, or slits 180 and 182 and the portion of the periphery therebetween is struck upwardly as shown to define tongues 184 and 186.

The installation plate 166 is attached to the sink S or counter through a customary 1½" opening O, normally provided to the side of the hot and cold water outlets at the rear of the sink. The downstruck nibs (beneath dimples 170, 172) abut the margin of the 1½" opening O. In instances where the opening O is smaller than 1½" appropriately located dimples or holes (not shown) may be made in the sink or counter top S so as to align with and receive the downward nibs formed in the undersurface of the installation plate 166 under the dimples 170 and 172 impressed therein.

As shown, the lower end of the bolt 176 receives an elongate clamping nut 200 having upturned ends. The nut is drilled and tapped as at 202 to receive the bolt 176 in threaded engagement.

The installation plate 166 is secured to the sink S by placing it over the opening O so that the nibs beneath the dimples 170 and 172 abut the edge of the opening O or are received into the dimples (not shown) in the top of the sink as described above. With the plate 166 in this position the threaded length of the bolt 176 extends down through the opening O with the clamping nut 200 disposed under the lower surface of the sink adjacent the opening O. Through the access opening 168, the installer will be able to reach down with his finger and maneuver the clamping nut 200 so that as the bolt 176 is tightened the nut 200, raises to engage the undersurface of the sink to clamp the sink between the plate 166 and the nut 200. The upturned ends of nut 200 serve when the bolt 176 is tight to bite into the sink. Under such compression the ends of the nut and the downward nibs under dimples 170 and 172 on the plate 166 immobilize the plate 166 in proper position.

In the further step of installation the preassembled base assembly 12 and valve 14, as described above, is aligned above the installation plate 166. The supply pipe 58, the inlet and outlet hoses I and O and the LCD wire are fed down through access 168 to be connected under the sink as is appropriate. A sealing O-ring 204 (FIG. 12) may surround the plate 166. The base assembly 12 is then brought down over plate 166 so that the outer portions of the shoe-shaped openings 160 and 162 receive the tongues 184 and 186 respectively. The base plate 68 is also formed with a clearance opening 178 to accommodate the head of the bolt 176 as the plates 68 and 166 turn relatively in installation.

Figure 13:
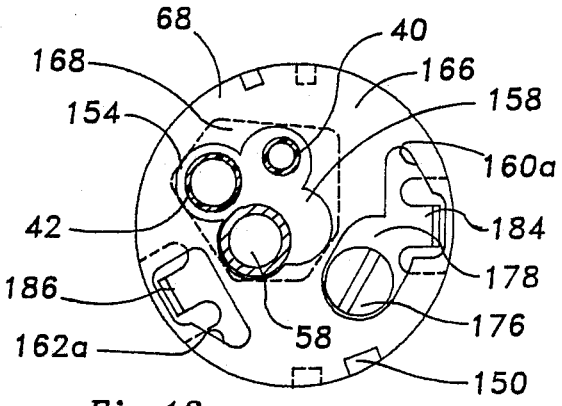
FIG. 13 is a sectional view taken on the line 13—13 of FIG. 1 showing the installation means of the invention and showing the parts prior to final installation position.
Figure 14:
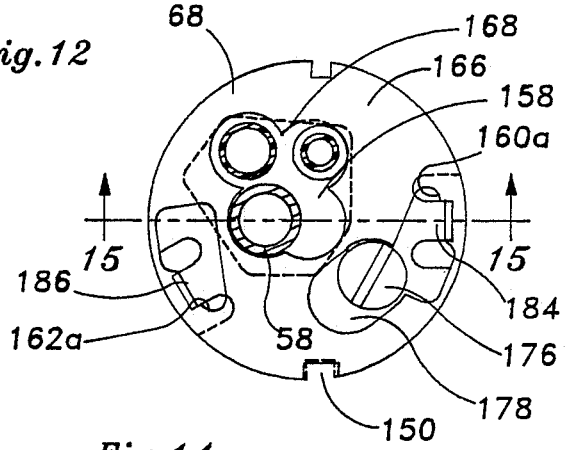
FIG. 14 is a sectional view like FIG. 13 but showing the parts in final position.
Figure 15:
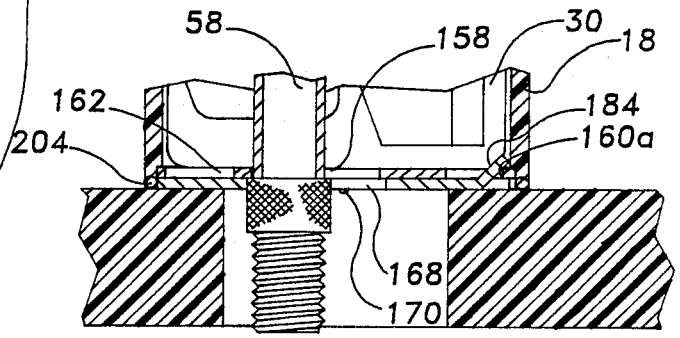
FIG. 15 is a fragmentary sectional view on the line 15—15 of FIG. 14 and, for simplicity eliminating the various hoses, fittings and wires.

The base assembly is then pressed down so that the O-ring 204 is squeezed between the bottom of the housing and the sink top. The base assembly 12 is then turned in a clockwise direction (FIGS. 13, 14) until the tongues 184, 182 wedge against the inclined openings 160*a* and 162*a* respectively. The amount of turning of the base assembly necessary may be only a matter of 10°–20° or so and yet the accessory faucet 10 is thereby firmly installed on the sink. The O-ring 204 serves to hold the plates firmly interlocked with the tongues 184, 186 engaging the inclines 160*a*, 162*a*. The O-ring also seals the base assembly to the sink so that water cannot seep into the housing and putrify.

It should be clear that there are decided advantages of the various aspects of the invention over the prior art. The invention may take the form of many different embodiments and hence is not limited to the structure described above and shown in the drawings. Instead, the invention may be defined by the following claim language or reasonable equivalents thereof.

What is claimed is:

1. For a waste line of a reverse-osmosis filter an air break module for installation on a sink or counter top, the air break module comprising a relatively thin body having at one side a vertically elongate port into a break pocket partly defined by an upward lip from the lower end of the pocket up to the port and top and bottom walls and vertical side and rear walls, the top wall having a section spaced inward from the port, the section having a vertically downwardly directed orifice therein, input passage means connecting the input of the waste line to the orifice, an outlet nozzle in the body disposed at the lower end of the bottom wall and terminating upwardly below the port and aimed generally toward the port and away from the orifice, and outlet passage means connected to the lower end of the nozzle for normally removing liquid from the pocket to waste.

2. An air break module as claimed in claim 1 wherein the input passage extends integral with the housing from the lower end thereof up to the orifice.

3. An air break as claimed in claim 1 wherein the nozzle aims toward the opening at an angle of about 20° to the vertical.

4. An air break as claimed in claim 1 wherein the module is enclosed in a housing having a slot aligned with the port.

5. An air break module as claimed in claim 4 wherein the housing also encloses a vertical faucet supply pipe, and a faucet surmounting the housing connects to the pipe for delivering filtered water from the filter to the faucet.

6. An air break module as claimed in claim 5 wherein the module is formed with a lateral fin extending in the direction opposite the pipe and the module is disposed inside the housing and immobilized because the opposite sides of the module engage opposite inside surfaces of the housing and the fin likewise engages the inside of the housing and urges the module against the pipe.

7. An air break module as claimed in claim 6 wherein one of the vertical walls is formed with an opening out through the side of the wall in a position adjacent the orifice.

8. An air break module as claimed in claim 7 wherein the rear wall and the top wall have molded therein the inlet passage means.

9. An air break module as claimed in claim 1 whereby upon reverse upward flow through the nozzle and out the port, a zone of negative pressure is created in the space defined by the section of the upper wall adjacent the side and end walls to draw input flow from the orifice out the port.

10. An air break module as claimed in claim 1 wherein the module body comprises a thin molded element having a recess therein to define one vertical wall, the top and the bottom and the rear walls, the upward lip and the port, and having a continuous shallow ledge surrounding the recess and being part of and inward from the top wall, the rear wall, the bottom wall and the lip; and a closure plate configured to the shape of the outer boundaries of the ledge and secured thereto to close the module and constitute the second vertical wall.

11. For a waste line of a reverse-osmosis filter an air break module for installation on a sink or counter top, the air break module comprising a body having at one side a vertically elongate port into a pocket defined by top and bottom walls the bottom wall having a lower end spaced back from the port and vertical side and rear walls, the top wall having a vertically downwardly directed orifice therein, input passage means connecting the input of the waste line to the orifice, outlet passage means in the lower end of the bottom wall for normally removing waste line liquid from the pocket and including an upwardly and outwardly slanted nozzle-like opening aimed out of the body through the port and away from the orifice.

12. An air break comprising a housing having an inlet fitting and an outlet fitting and a sidewall with a port leading to a downward pocket in the housing, an inlet orifice at the upper end of the pocket and connected to the inlet fitting and directed downward to the bottom of the pocket, an outlet drain nozzle at the bottom of the pocket connected to the outlet fitting, the outlet nozzle being inclined upwardly and outwardly toward the port and away from the inlet orifice.

* * * * *